US006636208B2

(12) United States Patent
Watanabe et al.

(10) Patent No.: US 6,636,208 B2
(45) Date of Patent: Oct. 21, 2003

(54) LCD DRIVE CIRCUIT

(75) Inventors: Hidetoshi Watanabe, Kobe (JP); Takeo Kamiya, deceased, late of Kobe (JP), by Hidetoshi Watanabe, legal representative

(73) Assignee: Koninklijke Philips Electronics N.V., Eindhoven (NL)

( * ) Notice: Subject to any disclaimer, the term of this patent is extended or adjusted under 35 U.S.C. 154(b) by 204 days.

(21) Appl. No.: 09/914,434

(22) PCT Filed: Dec. 22, 2000

(86) PCT No.: PCT/EP00/13361

§ 371 (c)(1),
(2), (4) Date: Aug. 27, 2001

(87) PCT Pub. No.: WO01/48728

PCT Pub. Date: Jul. 5, 2001

(65) Prior Publication Data

US 2002/0140648 A1 Oct. 3, 2002

(30) Foreign Application Priority Data

Dec. 28, 1999 (JP) ..... 11-373158

(51) Int. Cl.[7] ..... G09G 5/00

(52) U.S. Cl. ..... 345/208; 345/209; 345/204; 345/87; 345/53; 345/94

(58) Field of Search ..... 345/208, 209, 345/204, 53, 94, 87

(56) References Cited

U.S. PATENT DOCUMENTS 5,729,246 A * 3/1998 Masuko ..... 345/98
6,310,616 B1 * 10/2001 Yanagi et al. ..... 345/211

* cited by examiner

*Primary Examiner*—Bipin Shalwala
*Assistant Examiner*—Leonid Shapiro

(57) ABSTRACT

The liquid crystal driving circuit device has AC generating means (50) for generating an alternating current component of a drive signal, a capacitive element (3) with one terminal connected with said AC generating means, current limitation means (2) with one terminal connected with the other terminal of the capacitive element (3), and DC generating means (52, 53), for generating a direct current component of the drive signal, said DC generating means having an output connected to another terminal of the current limitation means (2). The capacitive element (3) eliminates the direct current component of an output signal from the AC generating means (50), and the current limitation means (2) limits a current caused by a voltage difference between a voltage at the other terminal of the capacitive element (3) and a voltage at the output. Further, an amplitude value of the alternating current component from the AC generating means and an amplitude of the alternating current component of a signal from the DC generating means (52, 53) are approximately the same.

2 Claims, 2 Drawing Sheets

LCD DRIVE CIRCUIT

DETAILED DESCRIPTION OF THE INVENTION

1. Technical Field of the Invention

This invention relates to a liquid crystal driving circuit device for driving a liquid crystal display panel and a the liquid crystal display device having the liquid crystal driving circuit device.

2. Prior Art

In driving a liquid crystal display panel, a voltage to be supplied to a pixel electrode is reversed every one line or one field. This is for prevention of deterioration of the pixel. For example, a gate voltage supplied to a certain row is expressed as a waveform shown in FIG. 4, and is constituted by a gate OFF level waveform of the driving voltage waveform reversing every one line and a gate ON level waveform for turning TFT on in the case of the liquid crystal display panel having a matrix type of TFTs (a thin film transistor). The voltage becomes a level designated as the gate ON level waveform and then TFT is turned into ON, when TFT in this row is selected. A gate voltage signal is generated by selecting a signal from a driving circuit for generating the gate OFF level waveform and a signal from the driving circuit for generating the gate ON level waveform by the switch circuit.

FIG. 3 shows an example of the driving circuit for generating the gate OFF level waveform of this gate voltage signal. The driving waveform having an amplitude value Vdv alternating between 0 V and a negative voltage is supplied from an amplitude source 50. In the driving waveform, a direct current component is cut off by a capacitor 51 and an alternating current component is derived out, and the direct current component is combined with the voltage made by dividing means having a resistor 52 and a resistor 53. The direct current component is a direct current voltage value obtained by dividing, with the resistor 52 and the resistor 53, a voltage difference between 0V at one end of the resistor 52 and a negative voltage VLC from a voltage source 54 at one end of the resistor 53. This combined driving waveform is sent to the switch circuit 55.

PROBLEMS TO BE SOLVED BY THE INVENTION

In this prior liquid crystal driving circuit device, when the driving waveform is switched from the gate OFF level waveform to the gate ON level waveform by the switch circuit 55 in order to turn TFT on, there were problems as follows.

The direct current voltage value VLdc in a point A caused by the dividing means is $VLdc=-R1\times Ia$ where Ia is a current value which flows to the resistor 52. And a reference symbol R1 is a resistance value of the resistor 52. When TFT of this row is selected, the voltage level designated as said gate ON level is selected, and a panel driving current Idc corresponding to this voltage level flows to the dividing means. The direct current voltage value VLdc in the point A at this time becomes $VLdc=-R1\times Ia+(R1\|R2)\times Idc$, where the resistance R2 is a resistance value of the resistor 53 and $R1\|R2$ means $R1\times R2/(R1+R2)$. As is apparent from this formula, the direct current voltage value VLdc in the point A is varied in response to the value of Idc. In order to minimize this variation, the current Ia should be made larger than the panel driving current Idc by minimizing the resistances R1 and R2.

On the other hand, there has been the problem that power consumption becomes larger when this current Ia is large, because the current Ia is a current only for generating the direct current voltage value VLdc. In order to minimize this current Ia, it is preferable that the resistances R1 and R2 are large.

Furthermore, the voltage source for supplying the alternating current component of a gate OFF level is preferably supplied by only the voltage source for driving the amplitude source 50, not from the voltage source for generating the direct current component. The reason is that electric power loss becomes large, because said electric power losses of the alternating current component is consumed in the power source for generating said negative voltage VLC, especially in the case that a voltage level of the power source for generating the negative voltage VLC is larger than a voltage level of the power source for generating the alternating current component sent by the amplitude source 50.

The object of the invention is to provide a liquid crystal driving circuit device in which variation in a direct current is smaller and is less in electric power loss.

MEANS FOR SOLVING THE PROBLEMS

A liquid crystal driving circuit device according to the invention is comprises

AC generating means for generating an alternating current component of said drive signal;

a capacitive element with one terminal connected with said AC generating means;

a current limitation means with one terminal connected with the other terminal of said capacitive element;

and DC generating means for generating a direct current component of said drive signal, said DC generating means having an output connected with the other terminal of said current limitation means, wherein said capacitive element eliminates a direct current component of an output signal from said AC generating means, and wherein said current limitation means limits a current caused by a voltage difference between a voltage at the other terminal of said capacitive element and a voltage at said output, further wherein an amplitude value of the alternating current component from said AC generating means and an amplitude value of the alternating current component of a signal from said output of said DC generating means are approximately the same.

Since the amplitude value of the alternating current component from the AC generating means and the amplitude value of the alternating current component of a signal from said output of the DC generating means are approximately the same, and said capacitive element is used, the voltage source for supplying the alternating current component of the gate OFF level can be supplied from the voltage source supplied to the AC generating means. Moreover, the panel driving current generated in turning on TFT prevents from flowing into the DC generating means by the current limitation means, whereby electric power to be consumed by the DC generating means can be minimized.

In the liquid crystal display device having the liquid crystal driving circuit device according to the invention, electric power loss may be reduced by a large amount.

EMBODIMENT OF THE INVENTION

Embodiments according to the invention will be described below.

FIG. 1 is a circuit block diagram showing one embodiment according to the invention. The amplitude source 50 supplying the driving voltage with the amplitude value Vdv is connected with an end of one side of the capacitors 3 and 51 respectively. The other end of the capacitor 51 is connected with each end of the resistors 52 and 53 and with an input of a buffer amplifier 1. The other end of the resistor 52 is connected at a ground of 0V. The other end of the resistor 53 is connected with the voltage source 54 which supplies the negative voltage VLC. One end of the resistor 2 is connected with output of the buffer amplifier 1, and the other end is connected with the other end of the capacitor 3 and the switch circuit 55.

An operation of this liquid crystal driving circuit device will be described below. The direct current component of the drive signal having the amplitude value Vdv from the amplitude source 50 is cut by the capacitor 3. The direct current component of this drive signal is given as the following description. A voltage difference between 0V and the negative voltage VLC is divided by a resistance division of the resistors 52 and 53. The divided voltage through the buffer amplifier 1 and the resistor 2 is combined with the alternating current component of said driving signal passed through the capacitor 3. The drive signal combined with the divided voltage is supplied to a gate electrode of TFT through the switch circuit 55.

The resistors 52 and 53 may be large resistance value, because the panel driving current from the switch circuit 55, when TFT is turned on, can not flow into the resistor 53 directly because of the existence of the resistor 2 and the buffer amplifier.

A voltage at an intersection point "a" of the other end of the capacitor 3, the other end of the resistor 2 and the switch circuit 55 is defined as VL1. The voltage at the output of the buffer amplifier 1 is defined as VL2. The capacitor 51 is coupled between the buffer amplifier 1 and the amplitude source 50. Since the alternating current component of the signal from the amplitude source 50 is supplied to the buffer amplifier 1 through the capacitor 51, the amplitude value of the alternating current component of the signal at the intersection "a" and the amplitude value of the alternating current component of the signal at output of the buffer amplifier 1 becomes approximately the same. Since these amplitude values are approximately the same, the alternating current component can not flow through the resistor 2, whereas only the direct current component may flow. Therefore, the alternating current component of the driving voltage waveform of the gate OFF level may be supplied through the capacitor 3 by the voltage source which supplies the voltage to the amplitude source 50. Especially, if the voltage level of the power source for generating the negative voltage VLC is larger than the voltage level of the power source for generating the alternating current component sent by the amplitude source 50, this may be advantageous in respect of power consumption.

FIG. 2 is a circuit block diagram showing the other embodiment according to the invention. An analog switch is used of the capacitor 51 of FIG. 1. The amplitude source 50 to supply the driving voltage having the amplitude value Vdv is connected with a switch control section of the analog switch 21 and the capacitor 3. The capacitor 23 and the voltage source 54 are connected with one input of the analog switch 21, and the negative voltage VLC is supplied from the voltage source 54. A voltage between 0V and the negative voltage VLC is generated by the resistance division of the resistors 52 and 53, and it is supplied to an input of the buffer amplifier 1. An output of the buffer amplifier 1 is connected with the other input of the analog switch 21 and the capacitor 22. An output of the analog switch 21 is connected with one end of the resistor 2. The other end of the resistor 2 is connected with the other end of the capacitor 3 and an input of the switch circuit 55.

An operation of this circuit will be described below. The direct current component of the signal from the amplitude source 50 is cut by the capacitor 3, and only the alternating current component is combined with a direct current component which will be described below, and the combined current component is supplied to the switch circuit 55. The voltage between 0V and the negative voltage VLC is supplied to one input of the analog switch 21 through the buffer amplifier 1. The negative voltage VLC is supplied to the other input of the analog switch 21 through the voltage source 54. These input voltages are selected by the signal from the amplitude source 50. Since the amplitude value of the alternating current component of the signal at the output of the analog switch 21 and the amplitude value of the alternating current component of the signal from the amplitude source 50 through the capacitor 3 are approximately the same, the current of the alternating current component can not flow to the resistor 2, and only the direct current component may flow. Therefore, the alternating current component of the driving waveform of a gate OFF level can be supplied through the capacitor 3 by the voltage source to supply the voltage to the amplitude source 50. The resistors 52 and 53 may be large resistance values, because the panel driving current from the switch circuit 55, when TFT is turned on, can not flow into the resistor 53 directly because of the existence of the resistor 2 and the buffer amplifier. Furthermore, there is the advantage that ability of a slew-rate of the buffer amplifier 1 can not become insignificant as compared with the embodiment in FIG. 1, because only the direct current voltage from the resistance division means is supplied to the buffer amplifier 1. Furthermore, since the capacitor 22 and 23 are operated as a back-up current source, a current consumption of the buffer amplifier 1 can be reduced.

EFFECTS OF THE INVENTION

As described above, according to this invention, the electric power can be reduced by a large amount, moreover, variation in the direct current voltage of the gate OFF level can be reduced when TFT is turned on.

DESCRIPTION OF REFERENCE NUMERALS

Figure 1:
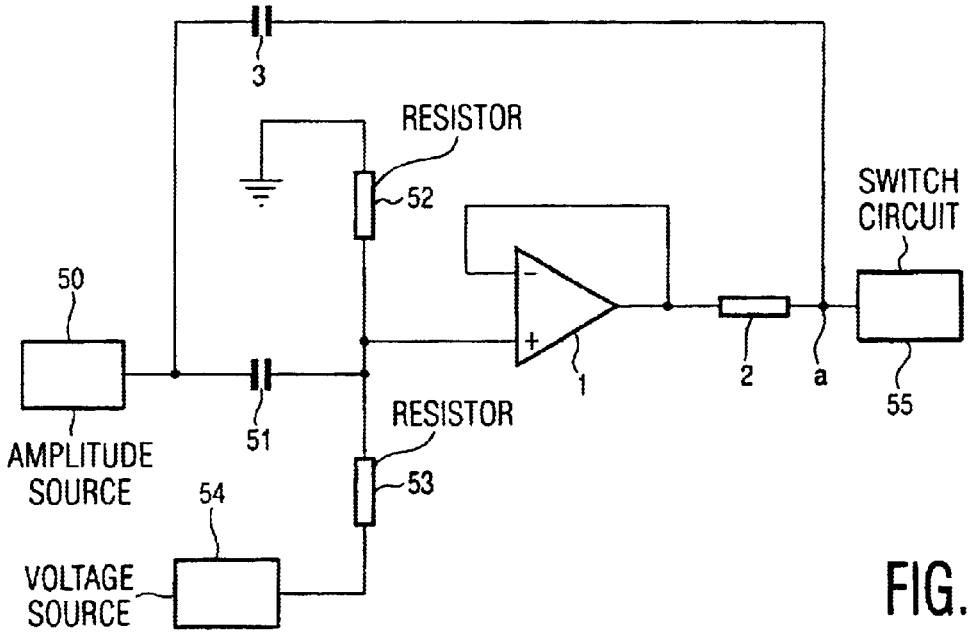
FIG. 1 shows a block diagram representing a liquid crystal driving circuit device according to the invention.
Figure 2:
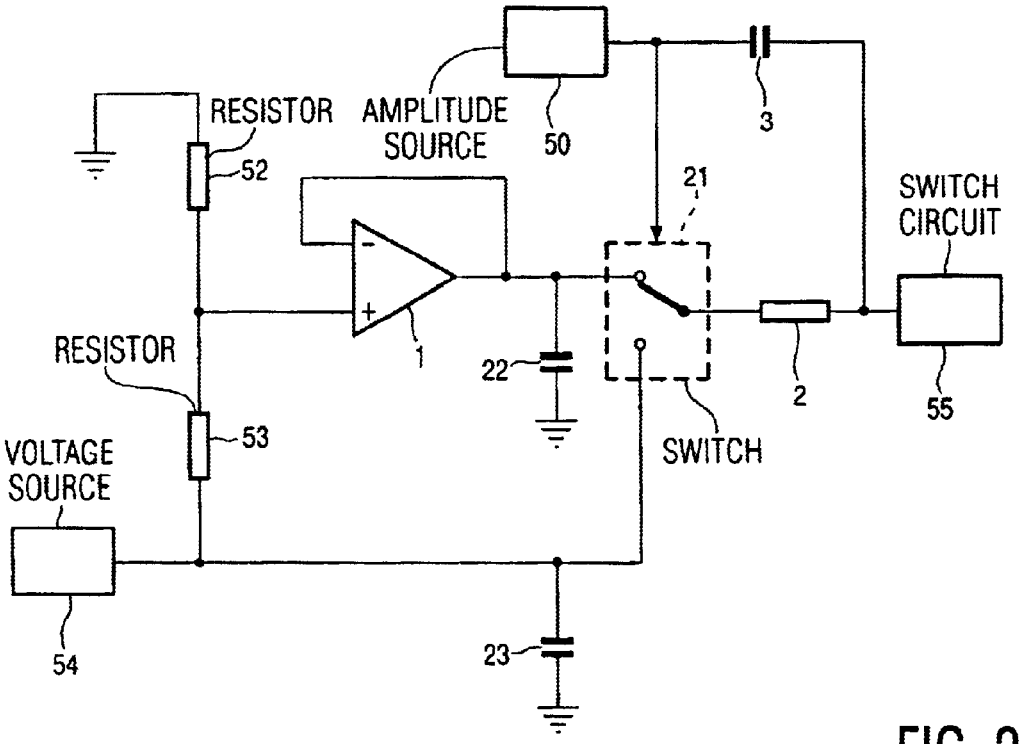
FIG. 2 shows a block diagram representing a liquid crystal driving circuit device for another embodiment of the invention.
Figure 3:
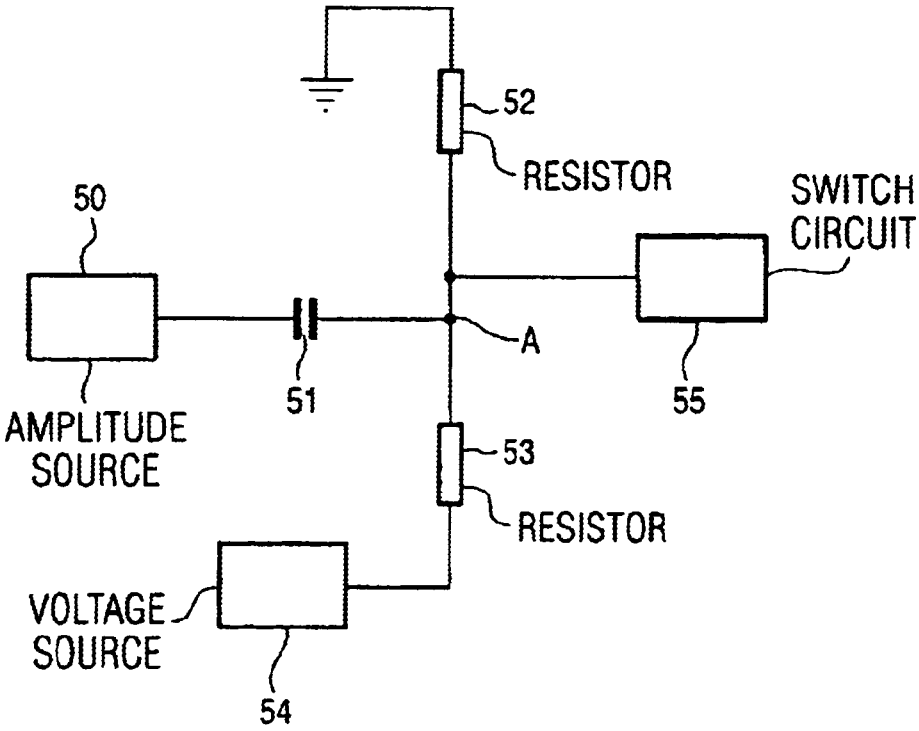
FIG. 3 PRIOR ART
FIG. 3 shows a block diagram representing a liquid crystal driving circuit device for the prior art.
Figure 4:
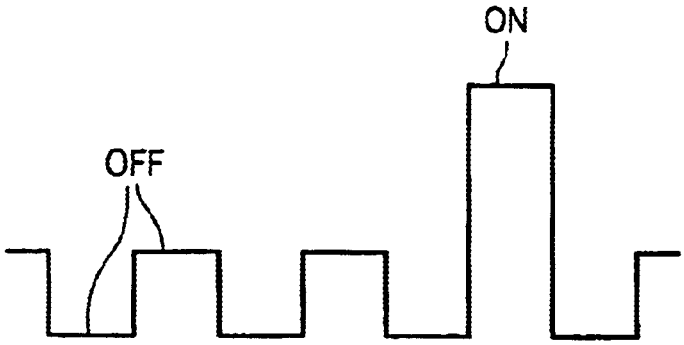
FIG. 4 PRIOR ART
FIG. 4 shows a gate signal waveform.

| | |
|---|---|
| 1 | buffer amplifier |
| 2, 52, 53 | resistor |
| 3, 51 | capacitor |
| 21 | analog switch |
| 50 | amplification source |
| 54 | voltage source |
| 55 | switch circuit |

What is claimed is:

1. A liquid crystal driving circuit device which generates a drive signal for a liquid crystal display panel, comprising: AC generating means for generating an alternating current component of said drive signal; a capacitive element with one terminal connected with said AC generating means; a current limitation means with one terminal connected with other terminal of said capacitive element; and DC generating means for generating a direct current component of said drive signal, said DC generating means having an output connected with the other terminal of said current limitation means, wherein said capacitive element eliminates a direct current component of an output signal from said AC generating means, and wherein said current limitation means limits a current caused by a voltage difference between a voltage at the other terminal of said capacitive element and a voltage at said output, further wherein an amplitude value of the alternating current component from said AC generating means and an amplitude value of the alternating current component of a signal from said output of said DC generating means are approximately the same.

2. The liquid crystal display device having the liquid crystal driving circuit device as claimed in claim 1.

* * * * *